US011637385B2

(12) United States Patent
Islam et al.

(10) Patent No.: US 11,637,385 B2
(45) Date of Patent: Apr. 25, 2023

(54) COMMUNICATION DEVICE HAVING ANTENNA PAIRING BASED ON RELATIVE POSITIONS OF HOUSING PORTIONS

(71) Applicant: MOTOROLA MOBILITY LLC, Chicago, IL (US)

(72) Inventors: Md Rashidul Islam, Glen Ellyn, IL (US); Junsheng Zhao, Vernon Hills, IL (US); Kasra Ghaemi, Chicago, IL (US); Md Faisal Abedin, Lisle, IL (US); Mohammed R. Abdul-Gaffoor, Palatine, IL (US)

(73) Assignee: Motorola Mobility LLC, Chicago, IL (US)

( * ) Notice: Subject to any disclaimer, the term of this patent is extended or adjusted under 35 U.S.C. 154(b) by 3 days.

(21) Appl. No.: 17/170,545

(22) Filed: Feb. 8, 2021

(65) Prior Publication Data

US 2022/0255239 A1 Aug. 11, 2022

(51) Int. Cl.

| | |
|---|---|
| ***H01Q 21/28*** | (2006.01) |
| ***H01Q 3/24*** | (2006.01) |
| ***H01Q 5/50*** | (2015.01) |
| ***H01Q 1/24*** | (2006.01) |

(52) U.S. Cl.

CPC ..... *H01Q 21/28* (2013.01); *H01Q 1/243* (2013.01); *H01Q 3/24* (2013.01); *H01Q 5/50* (2015.01)

(58) Field of Classification Search

CPC ..... H01Q 21/28; H01Q 3/06; H01Q 3/247; H01Q 1/241–243; H01Q 3/24; H01Q 1/2266

See application file for complete search history.

(56) References Cited

U.S. PATENT DOCUMENTS

| | | | | |
|---|---|---|---|---|
| 7,444,175 | B2 | 10/2008 | Ito | |
| 7,653,421 | B2 | 1/2010 | Suzuki et al. | |
| 9,760,122 | B1 * | 9/2017 | Aurongzeb | G06F 1/1637 |
| 10,148,304 | B2 * | 12/2018 | Chang | H04W 52/367 |
| 10,312,973 | B1 * | 6/2019 | Luo | H01Q 1/243 |
| 10,554,243 | B2 | 2/2020 | Bai | |

(Continued)

FOREIGN PATENT DOCUMENTS

| | | | | |
|---|---|---|---|---|
| CN | 104854809 B | * | 8/2018 | H04B 1/3827 |
| CN | 113748663 A | * | 12/2021 | H01Q 1/243 |

*Primary Examiner* — Ab Salam Alkassim, Jr.
*Assistant Examiner* — Anh N Ho
(74) *Attorney, Agent, or Firm* — Isidore PLLC

(57) ABSTRACT

A communication device, method and computer program product enable multiple transceiver communication by antennas within a configurable housing assembly. First, second, and third antennas are separate in an open position and are proximate and aligned in a closed position. A first radio frequency (RF) transceiver communicates via the first antenna and a second RF transceiver that communicates via one of the second and third antennas via the first antenna switch. A controller is communicatively coupled to a first antenna switch and a housing sensor. In response to determining that the housing assembly is in at least partially open position, the controller configures the first antenna switch to connect a second RF transceiver to a second antenna. In response to determining that the housing assembly is in the closed position, the controller configures the first antenna switch to connect the second RF transceiver to the third antenna.

20 Claims, 9 Drawing Sheets

(56) References Cited

U.S. PATENT DOCUMENTS

| | | | | |
|---|---|---|---|---|
| 2010/0022197 | A1* | 1/2010 | Kato | H04B 1/3805 725/62 |
| 2017/0272108 | A1 | 9/2017 | Filipovic | |
| 2019/0036217 | A1* | 1/2019 | Presti | H04B 1/0064 |
| 2019/0103656 | A1* | 4/2019 | Shi | G06F 1/1683 |
| 2020/0274570 | A1* | 8/2020 | Han | H04W 52/283 |
| 2021/0050669 | A1* | 2/2021 | Cha | H04B 1/18 |
| 2021/0345258 | A1* | 11/2021 | Yang | H04B 17/102 |
| 2022/0344807 | A1* | 10/2022 | You | H01Q 9/42 |

* cited by examiner

COMMUNICATION DEVICE HAVING ANTENNA PAIRING BASED ON RELATIVE POSITIONS OF HOUSING PORTIONS

TECHNICAL FIELD

The present disclosure relates generally to communication devices having multiple antennas that support simultaneous communication channels, and more particularly to communication devices having multiple antennas that support simultaneous communication channels within a configurable housing assembly.

DESCRIPTION OF THE RELATED ART

Communication devices, such as smartphones, incorporate a number of antennas to support multiple frequency bands assigned to various types of communication networks. Cellular network technology has developed in stages that are referred to as generations (G). Cellular communications have expanded into multiple communication bands and modulation schemes through the evolution of the telecommunications standard from first generation (1G), second generation (2G), third generation (3G), fourth generation (4G), and now fifth generation (5G). Newer generation radio access technologies (RATs) include additional communications bands and communication techniques that require coordinated use of multiple antennas. Recent designs of communication devices incorporate an increased number of antennas and antenna arrays for spatial diversity, carrier aggregation, dual connectivity, and directional antenna gain using multiple input multiple output (MIMO) operations.

Conventionally, communication devices having a "candy bar" form factor that do not fold or close have an antenna architecture that spaces antennas around a periphery of a unitary housing. Conventional communication devices having a configurable housing with a flip form factor ("flip phone") are generally smaller with insufficient places to put antennas when closed for antenna isolation. During folding or closing, components in one movable portion of the communication device are brought close to components in the other portion of the communication device, changing antenna performance for certain antennas or antenna arrays. Lower RF bands are affected when the flip phone is folded or closed. When closed, the flip phones lose functionality for simultaneous communication by multiple transceivers.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Figure 1:
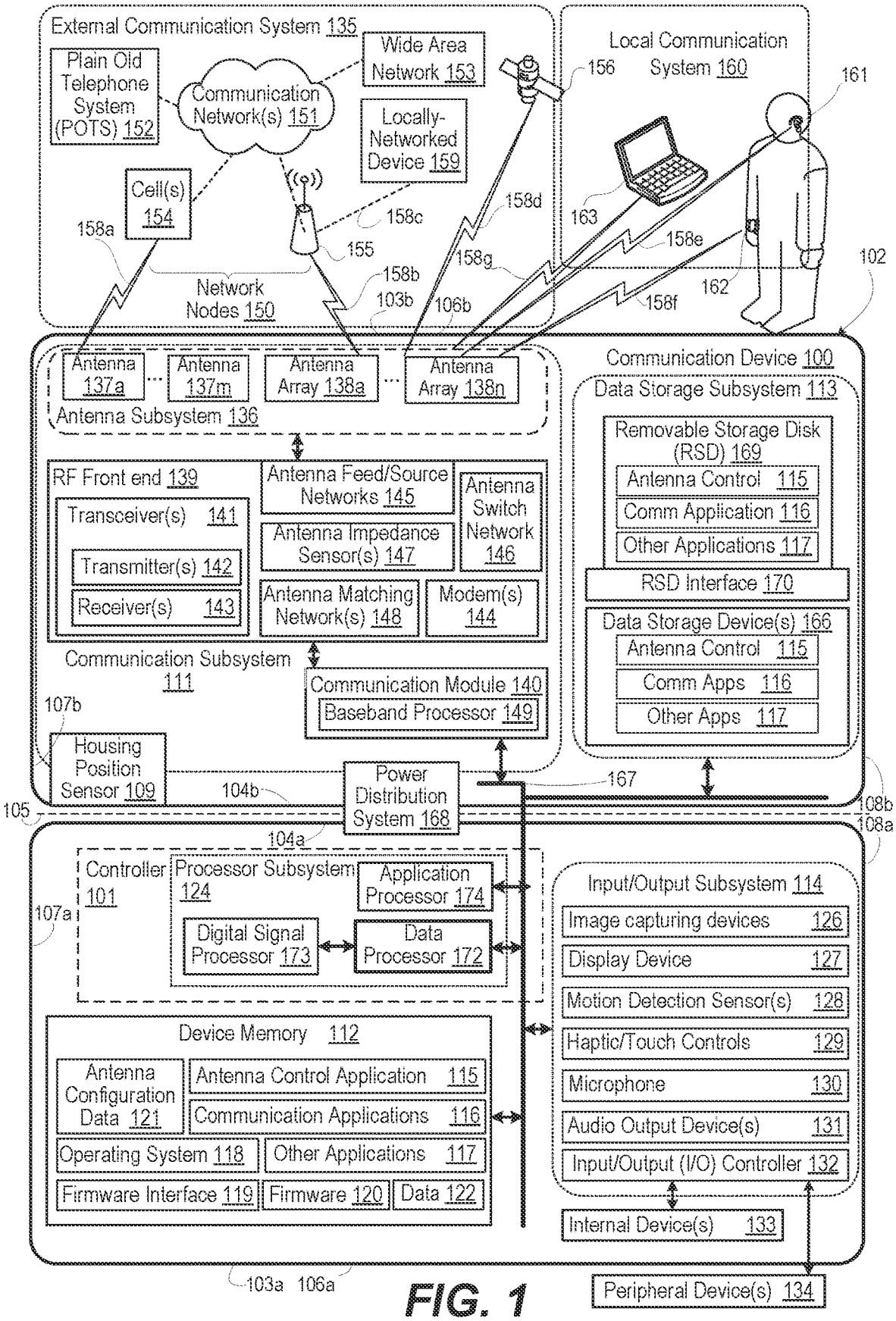
FIG. 1 depicts a functional block diagram of a communication device having multiple antennas operating in a communication environment and within which the features of the present disclosure are advantageously implemented, according to one or more embodiments.

According to aspects of the present disclosure, a communication device, a computer program product, and a method enable multi-transceiver communication with antennas supported on opposing portions of a configurable housing assembly. A communication device includes a housing assembly having first and second housing portions connected at respective proximal sides for relative movement between an open position and a closed position about a lateral axis. The first housing portion has a distal side and a proximal side. The first housing portion has first and second lateral sides extending between the proximal side and the distal side. The second housing portion has a distal side and a proximal side. The second housing portion has first and second lateral sides extending between the proximal side and the distal side. The communication devices include at least three antennas each having an elongated shape and configured to communicate in one or more radio frequency (RF) communication bands including a low band. First, second and third antennas are separated when the housing assembly is in the open position. The first antenna is within the first housing portion. The second antenna is within the second housing portion. The third antenna is within one of the first and the second housing portions. The first antenna is proximate to and substantially aligned in parallel with the second antenna and separated from the third antenna when the housing assembly is in the closed position.

The communication device includes a first antenna switch, an RF front end, a housing position sensor, and a controller. The RF front end has a first RF transceiver that communicates via the first antenna and has a second RF transceiver that communicates via a selected one of the second and the third antennas via the first antenna switch. The housing position sensor is within the housing assembly and detects: (i) when the housing assembly is in the closed position; and (ii) when the housing assembly is in an at least partially open position. The controller is communicatively coupled to the first antenna switch and the housing sensor. In response to determining that the housing assembly is in the at least partially open position, the controller configures the first antenna switch in a first state to connect the second RF transceiver to the second antenna. In response to determining that the housing assembly is in the closed position, the controller configures the first antenna switch in a second state to connect the second RF transceiver to the third antenna.

In one or more embodiments, the communication device supports a two-way antenna switch diversity RF architecture. Multiple antennas support various operating modes and use cases. Each RF transceiver chain of the RF architecture is connected to a separate antenna. Each RF transceiver chain includes a transmitter and/or receiver and other supporting functional components that are communicatively connected to a particular antenna for communicating an uplink or a downlink. The communication device can have more than one active RF transceiver chain. Certain RF transceiver chains are switched to avoid potential detrimental effects of having a connected antenna that is close to and thus causes interference with another antenna when the housing is in the closed position. Antennas that are not connected to an RF transceiver chain can be used to detect blocking, such as by a hand or ear of a user of the communication device. For clarity, embodiments of the communication device can have a two piece housing assembly that folds symmetrically. However, aspects of the present disclosure can be used with configurable housings that slide together and extend from each other or attach and detach from each other. In the described embodiments, a symmetric two piece housing assembly is provided as the example device. Aspects of the present disclosure can be used in housing assemblies with more than two connected portions and in housing assemblies having two portions that are not similar in shape.

In the following detailed description of exemplary embodiments of the disclosure, specific exemplary embodiments in which the various aspects of the disclosure may be practiced are described in sufficient detail to enable those skilled in the art to practice the invention, and it is to be understood that other embodiments may be utilized and that logical, architectural, programmatic, mechanical, electrical, and other changes may be made without departing from the spirit or scope of the present disclosure. The following detailed description is, therefore, not to be taken in a limiting sense, and the scope of the present disclosure is defined by the appended claims and equivalents thereof. Within the descriptions of the different views of the figures, similar elements are provided similar names and reference numerals as those of the previous figure(s). The specific numerals assigned to the elements are provided solely to aid in the description and are not meant to imply any limitations (structural or functional or otherwise) on the described embodiment. It will be appreciated that for simplicity and clarity of illustration, elements illustrated in the figures have not necessarily been drawn to scale. For example, the dimensions of some of the elements are exaggerated relative to other elements.

It is understood that the use of specific component, device and/or parameter names, such as those of the executing utility, logic, and/or firmware described herein, are for example only and not meant to imply any limitations on the described embodiments. The embodiments may thus be described with different nomenclature and/or terminology utilized to describe the components, devices, parameters, methods and/or functions herein, without limitation. References to any specific protocol or proprietary name in describing one or more elements, features or concepts of the embodiments are provided solely as examples of one implementation, and such references do not limit the extension of the claimed embodiments to embodiments in which different element, feature, protocol, or concept names are utilized. Thus, each term utilized herein is to be given its broadest interpretation given the context in which that term is utilized.

As further described below, implementation of the functional features of the disclosure described herein is provided within processing devices and/or structures and can involve use of a combination of hardware, firmware, as well as several software-level constructs (e.g., program code and/or program instructions and/or pseudo-code) that execute to provide a specific utility for the device or a specific functional logic. The presented figures illustrate both hardware components and software and/or logic components.

Those of ordinary skill in the art will appreciate that the hardware components and basic configurations depicted in the figures may vary. The illustrative components are not intended to be exhaustive, but rather are representative to highlight essential components that are utilized to implement aspects of the described embodiments. For example, other devices/components may be used in addition to or in place of the hardware and/or firmware depicted. The depicted example is not meant to imply architectural or other limitations with respect to the presently described embodiments and/or the general invention. The description of the illustrative embodiments can be read in conjunction with the accompanying figures. Embodiments incorporating teachings of the present disclosure are shown and described with respect to the figures presented herein.

FIG. 1 is a functional block diagram of an electronic device, and more particularly communication device 100, which is managed by controller 101, in an operating environment within which the features of the present disclosure are advantageously implemented. According to one aspect, communication device 100 includes housing assembly 102 that is configurable by having first and second housing portions 103*a*-103*b* that are connected at respective first and second proximal sides 104*a*-104*b* for relative movement between an open position and a closed position about lateral axis 105. Each of first and the second housing portions 103*a*-103*b* have a respective distal side 106*a*-106*b* opposite to respective proximal sides 104*a*-104*b*. First lateral side 107*a* and second lateral side 108*a* extend between proximal side 104*a* and distal side 106*a* of first housing portion 103*a*. First lateral side 107*b* and second lateral side 108*b* extend between proximal side 104*b* and distal side 106*b* of second housing portion 103*b*. Controller 101 is communicatively coupled to housing position sensor 109 that detects when housing assembly 102 is in: (i) a closed position; and (ii) at least a partially open position or a fully open position. Controller 101 configures communication subsystem 111 based at least in part on the position of housing assembly 102.

Communication device 100 can be one of a host of different types of devices, including but not limited to, a mobile cellular phone, satellite phone, or smart-phone, a laptop, a net-book, an ultra-book, a networked smart watch, or networked sports/exercise watch, and/or a tablet computing device or similar device that can include wireless and/or wired communication functionality. As an electronic device supporting wireless communication, communication device 100 can be utilized as, and also be referred to as, a system, device, subscriber unit, subscriber station, mobile station (MS), mobile, mobile device, remote station, remote terminal, user terminal, terminal, user agent, user device, a Session Initiation Protocol (SIP) phone, a wireless local loop (WLL) station, a personal digital assistant (PDA), computer workstation, a handheld device having wireless connection capability, a computing device, or other processing devices connected to a wireless modem.

Referring again to the specific component makeup and the associated functionality of communication device 100. In one or more embodiments, communication device 100 includes communication subsystem 111, device memory 112, data storage subsystem 113, and input/output (I/O) subsystem 114. Device memory 112 and each subsystem (111, 113, and 114) are managed by controller 101. Device memory 112 includes program code and applications such as antenna control application 115, communication applications 116, and other application(s) 117 that use communication services. Device memory 112 further includes operating system (OS) 118, firmware interface 119, such as basic input/output system (BIOS) or Uniform Extensible Firmware Interface (UEFI), and firmware 120. Device memory 112 includes antenna configuration data 121 or other computer data 122 used by antenna control application 115.

Processor subsystem 124 of controller 101 executes program code to provide operating functionality of communication device 100. The software and/or firmware modules have varying functionality when their corresponding program code is executed by processor subsystem 124 or secondary processing devices within communication device 100. Processor subsystem 124 of controller 101 can execute program code of antenna control application 115 to configure communication sub system 111.

I/O subsystem 114 includes image capturing device(s) 126. I/O subsystem 114 includes user interface devices such as display device 127, motion detection sensors 128, touch/haptic controls 129, microphone 130, and audio output device(s) 131. I/O subsystem 114 also includes I/O controller 132. In one or more embodiments, motion detection sensors 128 can detect an orientation and movement of the communication device 100 that indicates that the communication device 100 should activate display device 127 or should vertically reorient visual content presented on display device 127. In one or more embodiments, motion detection sensors 128 are used for functions other than user inputs, such as detecting an impending ground impact. I/O controller 132 connects to internal devices 133, which are internal to housing assembly 102 and to peripheral devices 134, such as external speakers, which are external to housing assembly 102 of communication device 100. Examples of internal devices 133 are computing, storage, communication, or sensing components depicted within housing assembly 102. I/O controller 132 supports the necessary configuration of connectors, electrical power, communication protocols, and data buffering to act as an interface to internal devices 133 and peripheral devices 134 to other components of communication device 100 that use a different configuration for inputs and outputs.

Communication sub system 111 of communication device 100 enables wireless communication with external communication system 135. Communication subsystem 111 includes antenna subsystem 136 having lower band antennas 137*a*-137*m* and higher band antenna array modules 138*a*-138*n* that can be attached in/at different portions of housing assembly 102. Multiple radio frequency (RF) bands, including ultra-low band (UL), low band (LB), mid-band (MB), high band (HB), and ultra-high band (UHB), are supported by the various antennas within the communication devices. Particular public land mobile network (PLMN) and radio access technology (RAT) combinations, as well as services based on 802.11 wireless and global positioning system (GPS) signals, can use one or more of these RF bands.

Communication subsystem 111 includes radio frequency (RF) front end 139 and communication module 140. RF front end 139 includes transceiver(s) 141, which includes transmitter(s) 142 and receiver(s) 143. RF front end 139 further includes modem(s) 144. RF front end 139 includes antenna feed/source networks 145, antenna switch network 146, antenna impedance sensor(s) 147, and antenna matching network(s) 148. Communication module 140 of communication subsystem 111 includes baseband processor 149 that communicates with controller 101 and RF front end 139. Baseband processor 149 operates in baseband frequency range to encode data for transmission and decode received data, according to a communication protocol. Modem(s) 144 modulate baseband encoded data from communication module 140 onto a carrier signal to provide a transmit signal that is amplified by transmitter(s) 142. Modem(s) 144 demodulates each signal received from external communication system 135 detected by antenna subsystem 136. The received signal is amplified and filtered by receiver(s) 143, which demodulate received encoded data from a received carrier signal. Antenna feed/source networks 145 transmits or receives from particular portions of antenna subsystem 136 and can adjust phase between particular portions of antenna subsystem 136. Antenna switch network 146 can connect particular combinations of antennas (137*a*-137*m*, 138*a*-138*n*) to transceiver(s) 141. Controller 101 can monitor changes in antenna impedance detected by antenna impedance sensor(s) 147 for determining portions of antenna subsystem 136 that are blocked. Antenna matching network(s) 148 are connected to particular lower band antennas 137*a*-137*m* to tune impedance respectively of lower band antennas 137*a*-137*m* to match impedance of transceivers 141. Antenna matching network(s) 148 can also be used to detune the impedance of lower band antennas 137*a*-137*m* to not match the impedance of transceivers 141 to electromagnetically isolate a particular antenna.

Housing position sensor 109 can be one of: (i) a two-position binary switch which detects the closed position and any other position considered partially open position (i.e., not a closed position); (ii) a multiple position switch of discrete values; or (iii) a continuous range sensor. The at least partially open position of housing assembly 102 can be one or more positions greater than 0° and less than 180° defined as pivot angles between first and second housing portions 103*a*-103*b*. With each implementation, housing position sensor 109 detects the partially open position based on the two housing portions being a predetermined distance or number of degrees apart from each other (e.g., at 30° or 45°). The distance or number of degrees can be empirically determined to correspond with when the antennas are sufficiently apart for a particular operational mode of communication device 102. As an example, the defined pivot angles can be based on one or more considerations such as: (i) capabilities of housing position sensor 109 (FIG. 1); (ii) mechanically available positions of housing position 102;

(iii) usability of user interface components; and (iv) spatial coverage of antennas 137*a*-137*d* as a function of pivot angle. As one example, housing assembly 102 can have a pivot mechanism that is stable in three positions: (i) fully closed; (ii) open 90°; and (iii) fully open. At least partially open position can be based on a pivot position of at least 45° that corresponds to activating a front display device in preparation for viewing at 90° or fully open. As another example, certain pivot positions affect ability to communicate in certain spatial directions. detecting one or more positions of housing 102 can be used to select antennas 137*a*-137*d* for spatial diversity.

In one or more embodiments, controller 101, via communication subsystem 111, performs multiple types of over-the-air (OTA) communication with network nodes 150 of external communication system 135. Particular network nodes 150 can be part of communication networks 151 of public land mobile networks (PLMNs) that provide connections to plain old telephone systems (POTS) 152 for voice calls and wide area networks (WANs) 153 for data sessions. WANs 115 can include Internet and other data networks. The particular network nodes 150 can be cells 154 such as provided by base stations or base nodes that support cellular OTA communication using RAT as part of a radio access network (RAN). Unlike earlier generations of cellular services, where voice and data were handled using different RATs, both are now integrated with voice being considered one kind of data communication. Conventionally, broadband, packet-based transmission of text, digitized voice, video, and multimedia communication are provided using Fourth generation (4G) RAT of evolved UTMS radio access (E-UTRA), referred to a Long Term Evolved (LTE), although some cellular data service is still being provided by third generation (3G) Universal Mobile Telecommunications Service (UMTS). A fifth generation (5G) RAT, referred to as fifth generation new radio (5G NR), is being deployed to at least augment capabilities of 4G LTE with a yet higher capability of data transfer. Development continues for what will be six generation (6G) RATs and more advanced RATs.

In one or more embodiments, network nodes 150 can be access node(s) 155 that support wireless OTA communication. Communication subsystem 111 can receive OTA communication from location services such as provided by global positioning system (GPS) satellites 156. Communication subsystem 111 communicates via OTA communication channel(s) 158*a* with cells 154. Communication subsystem 111 communicates via wireless communication channel(s) 158*b* with access node 155. In one or more particular embodiments, access node 155 supports communication using one or more IEEE 802.11 wireless local area network (WLAN) protocols. Wi-Fi is a family of wireless network protocols, based on the IEEE 802.11 family of standards, which are commonly used between user devices and network devices that provide Internet access. In one or more particular embodiments, communication subsystem 111 communicates with one or more locally networked devices 159 via wired or wireless link 158*c* provided by access node 155. Communication subsystem 111 receives downlink broadcast channel(s) 158*d* from GPS satellites 156 to obtain geospatial location information.

In one or more embodiments, controller 101, via communication subsystem 111, performs multiple types of OTA communication with local communication system 160. In one or more embodiments, local communication system 160 includes wireless headset 161 and smart watch 162 that are coupled to communication device 100 to form a personal access network (PAN). Communication subsystem 111 communicates via low power wireless communication channel(s) 158*e* with headset 161. Communication subsystem 111 communicates via second low power wireless communication channel(s) 158*f*, such as Bluetooth, with smart watch 162. In one or more particular embodiments, communication subsystem 111 communicates with other communication device(s) 163 via wireless link 158*g* to form an ad hoc network.

Data storage subsystem 113 of communication device 100 includes data storage device(s) 166. Controller 101 is communicatively connected, via system interlink 167, to data storage device(s) 166. Data storage subsystem 113 provides applications, program code, and stored data on nonvolatile storage that is accessible by controller 101. For example, data storage subsystem 113 can provide a selection of program code and applications such as antenna control application 115, communication applications 116, and other application(s) 117 that use communication services. These applications can be loaded into device memory 112 for execution by controller 101. In one or more embodiments, data storage device(s) 166 can include hard disk drives (HDDs), optical disk drives, and/or solid-state drives (SSDs), etc. Data storage subsystem 113 of communication device 100 can include removable storage device(s) (RSD(s)) 169, which is received in RSD interface 170. Controller 101 is communicatively connected to RSD 169, via system interlink 167 and RSD interface 170. In one or more embodiments, RSD 169 is a non-transitory computer program product or computer readable storage device. Controller 101 can access RSD 169 or data storage device(s) 166 to provision communication device 100 with program code, such as antenna control application 115 and other applications 117. When executed by controller 101, the program code causes or configures communication device 100 to provide the multi-transceiver operational functionality using configurable housing assembly 102 described herein.

Controller 101 includes processor subsystem 124, which includes one or more central processing units (CPUs), depicted as data processor 172. Processor subsystem 124 can include one or more digital signal processors 173 that are integrated with data processor 172 or are communicatively coupled to data processor 172, such as baseband processor 149 of communication module 140. Controller 101 can include one or more application processor(s) 174 to monitor sensors or controls such as housing position sensor 109 and antenna switch network 146. In one or embodiments that are not depicted, controller 101 can further include distributed processing and control components that are peripheral or remote to housing assembly 102 or grouped with other components, such as I/O subsystem 114. Data processor 172 is communicatively coupled, via system interlink 167, to device memory 112. In one or more embodiments, controller 101 of communication device 100 is communicatively coupled via system interlink 167 to communication subsystem 111, data storage subsystem 113, and input/output subsystem 114. System interlink 167 represents internal components that facilitate internal communication by way of one or more shared or dedicated internal communication links, such as internal serial or parallel buses. As utilized herein, the term "communicatively coupled" means that information signals are transmissible through various interconnections, including wired and/or wireless links, between the components. The interconnections between the components can be direct interconnections that include conductive transmission media or may be indirect interconnections that include one or more intermediate electrical components. Although certain direct interconnections (interlink 167) are illustrated in FIG. 1, it is to be understood that more, fewer, or different interconnections may be present in other embodiments. Interlink 167 communicatively connects components in first housing portion 103*a* to components in second housing portion 103*b*. Power distribution sub system 168 provides electrical power to components in first housing portion 103*a* and to components in second housing portion 103*b*.

Controller 101 manages, and in some instances directly controls, the various functions and/or operations of communication device 100. These functions and/or operations include, but are not limited to including, application data processing, communication with other communication devices, navigation tasks, image processing, and signal processing. In one or more alternate embodiments, communication device 100 may use hardware component equivalents for application data processing and signal processing. For example, communication device 100 may use special purpose hardware, dedicated processors, general purpose computers, microprocessor-based computers, micro-controllers, optical computers, analog computers, dedicated processors and/or dedicated hard-wired logic.

Figure 2A:
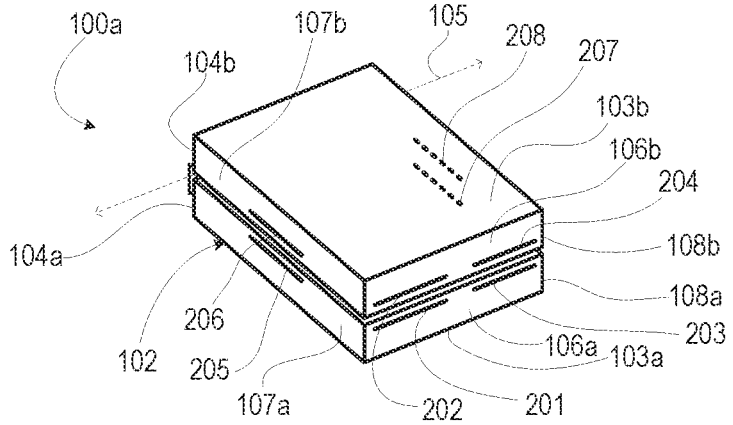
FIG. 2A depicts a three-dimensional view of an example communication device having a configurable housing assembly in a closed position, according to one or more embodiments.
Figure 2B:
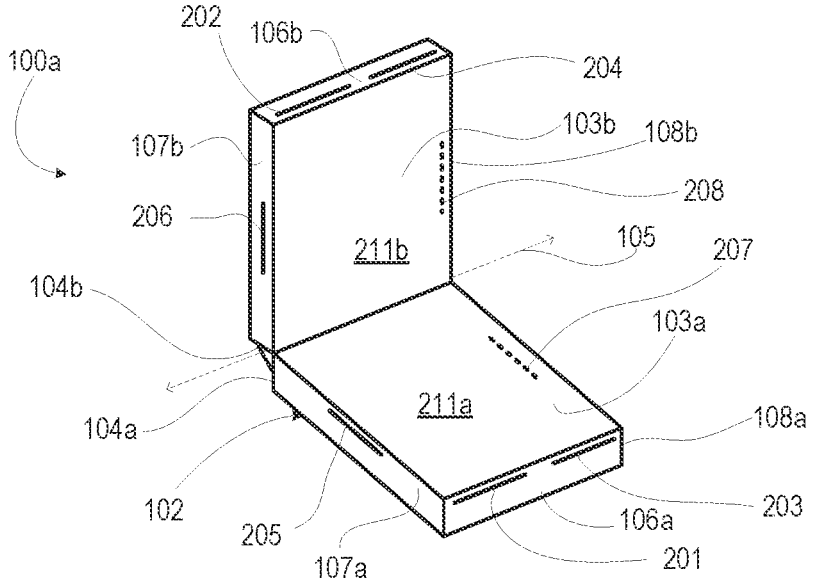
FIG. 2B depicts a three-dimensional view of the example communication device of FIG. 2A having the configurable housing assembly in a partially open position, according to one or more embodiments.
Figure 2C:
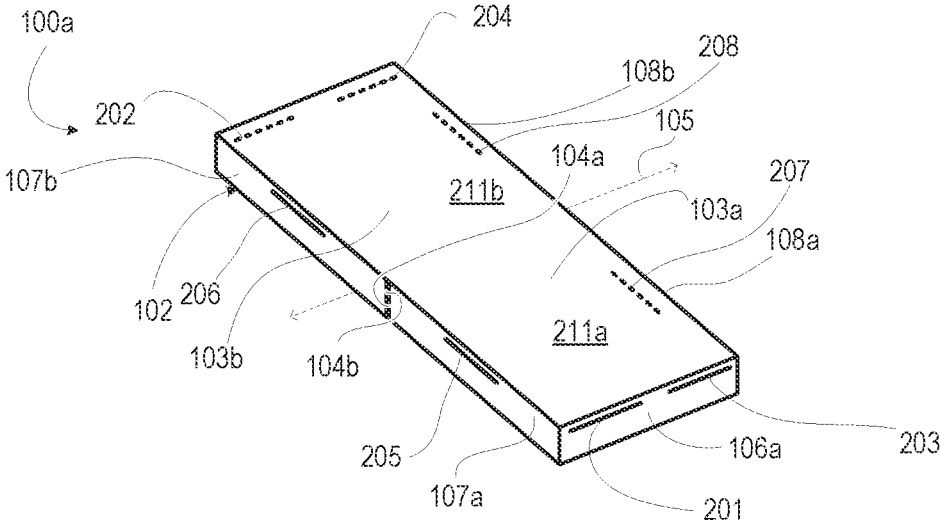
FIG. 2C depicts a three-dimensional view of the example communication device of FIG. 2A having the configurable housing assembly in a fully open position, according to one or more embodiments.

Within the description of the remaining figures, references to similar components presented in a previous figure are provided the same reference numbers across the different figures. Where the named component is presented with different features or functionality, a different reference numeral or a sub scripted reference numeral is provided (e.g., 100*a* in place of 100). FIG. 2A depicts a three-dimensional view of an example communication device 100*a* having housing assembly 102 configured in a closed position. Communication device 100*a* can have similar or identical components and functionality of communication device 100 (FIG. 1). FIG. 2B depicts a three-dimensional view of example communication device 100*a* having housing assembly 102 configured in a partially open position. FIG. 2C depicts a three-dimensional view of example communication device 100*a* having housing assembly 102 configured in a fully open position.

In FIGS. 2A-2C, communication device 100*a* includes housing assembly 102 that is configurable. Similar to FIG. 1, first and second housing portions 103*a*-103*b* of housing assembly 102 are connected at respective first and second proximal sides 104*a*-104*b*. First and second housing portions 103*a*-103*b* move relatively between an open position and a closed position about lateral axis 105. Each of first and the second housing portions 103*a*-103*b* have respective distal side 106*a*-106*b* opposite to proximal sides 104*a*-104*b*. First lateral side 107*a* and second lateral side 108*a* extend between proximal side 104*a* and distal side 106*a* of first housing portion 103*a*. First lateral side 107*b* and second lateral side 108*b* extend between proximal side 104*b* and distal side 106*b* of second housing portion 103*b*. In one embodiment, first housing portion 103*a* is a base, second housing portion 103*b* is a flip housing, first lateral sides 107*a*-107*b* are on the left, and second lateral sides 108*a*-108*b* are on the right.

According to one aspect, housing assembly 102 includes a plurality of possible antenna mounting locations, illustrated as antenna mounting locations 201-208. First antenna mounting location 201 is a left section of distal side 106*a* of first housing portion 103*a*. Second antenna mounting location 202 is a left section of distal side 106*b* of second housing portion 103*b*. Third antenna mounting location 203 is a right section of distal side 106*a* of first housing portion 103*a*. Fourth antenna mounting location 204 is a right section of distal side 106*b* of second housing portion 103*b*. Fifth antenna mounting location 205 is on left lateral side 107*a* of first housing portion 103*a*. Sixth antenna mounting location 206 is on left lateral side 107*b* of second housing portion 103*b*. Seventh antenna mounting location 207 is on right lateral side 108*a* of first housing portion 103*a*. Eighth antenna mounting location 208 on right lateral side 108*b* of second housing portion 103*b*. While housing assembly 102 is in the closed position of FIG. 2A, specific pairs of antenna mounting locations 201-208 are aligned proximate to each other across the base and flip housing. These aligned pairs include: (i) first and second antenna mounting locations 201-202; (ii) third and fourth antenna mounting locations 203-204; (iii) fifth and sixth antenna mounting locations 205-206; and (iv) seventh and eight antenna mounting locations 207-208. The close proximity impairs antenna efficiency at ultra-low band and low band. At a partially open position of housing assembly 102 in FIG. 2B, separation between first and second housing portions 103*a*-103*b* is sufficient for viewing front surfaces 211*a*-211*b* respectively of first and second housing portions 103*a*-103*b*. At a partially open position of housing assembly 102 in FIG. 2B, separation between paired antenna mounting locations 201-208 is sufficient antenna performance in low bands that is significantly the same as housing assembly 102 being in the fully open position of FIG. 2C. Two or more at least partially open positions of housing assembly 102 can be detected for triggering changes in an operational mode of communication device 100*a*, such as changing use of display devices 127 (FIG. 1). For clarity, eight (8) antenna mounting locations 201 208 for eight (8) antennas 137*a*-137*h* (FIG. 1) are described. In one or more embodiments, fewer or more antenna mounting locations can be provided for use with fewer or more antennas. In FIG. 2C, housing assembly 102 is in a fully open position with 180° rotation between first and second housing portions 103*a*-103*b*.

Figure 3A:
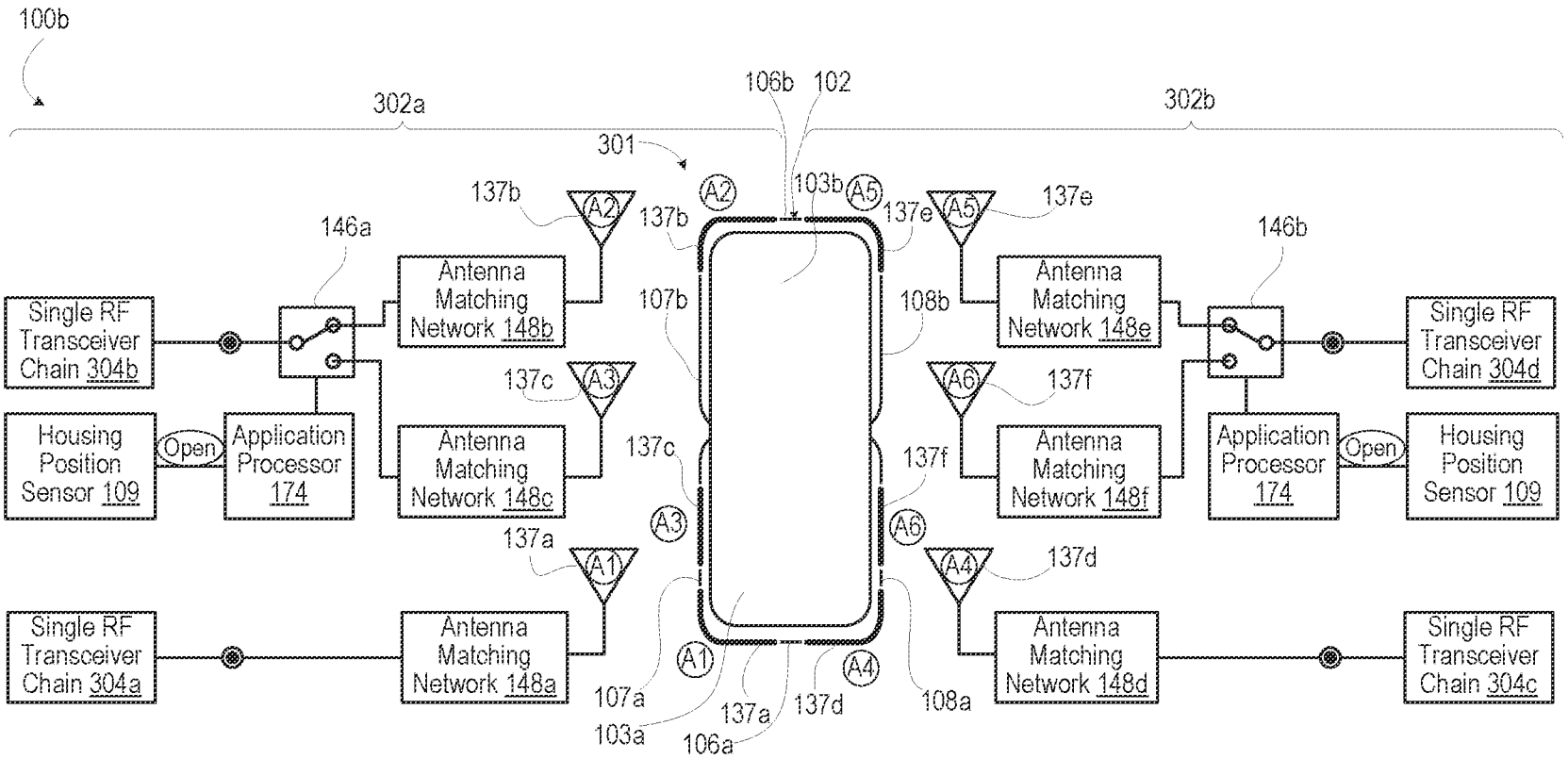
FIG. 3A depicts a functional block diagram of an example communication device having a configurable housing assembly supporting a first antenna arrangement in an open position, according to one or more embodiments.

FIG. 3A depicts a functional block diagram of example communication device 100*b* having first antenna arrangement 301 within housing assembly 102 that is in an open position. Communication device 100*b* can have identical or similar components and functionality as described for communication device 100 (FIG. 1). First antenna arrangement 301 is laterally symmetric, having first and second communication subsystem portions 302-302*b*. First communication subsystem portion 302*a* has antennas 137*a*-137*c* that support first and second single RF transceiver chains 304*a*-304*b*. First antenna 137*a* is positioned at a first lateral section of distal side 106*a* of first housing portion 103*a*. Second antenna 137*b* is positioned at a first lateral section of distal side 106*b* of second housing portion 103*b*. Third antenna 137*c* is positioned at first lateral side 107*a* of first housing portion 103*a*. First lateral side 107*b* of second housing portion 103*b* does not include an antenna. First single RF transceiver chain 304*a* is communicatively connected to first antenna 137*a* via antenna matching network 148*a*. Second single RF transceiver chain 304*b* is communicatively connected by first antenna switch 146*a* to either of second antenna 137*b* via antenna matching network 148*b* or third antenna 137*c* via antenna matching network 148*c*. In one or more embodiments, first antenna switch 146*a* is a two pole, single throw switch. In response to receiving an open position signal from housing position sensor 109, application processor 174 configures first antenna switch 146*a* to communicatively connect second single RF transceiver chain 304*b* to second antenna 137*b*.

Second communication subsystem portion 302*b* includes antennas 137*d*-137*f* that support third and fourth single RF transceiver chains 304*c*-304*d*. Fourth antenna 137*d* is positioned at a second lateral section of distal side 106*a* of first housing portion 103*a*. Fifth antenna 137*e* is positioned at a second lateral section of distal side 106*b* of second housing portion 103*b*. Sixth antenna 137*f* is positioned at second lateral side 108*a* of first housing portion 103*a*. Second lateral side 108*b* of second housing portion 103*b* does not include an antenna. Third single RF transceiver chain 304*c* is communicatively connected to fourth antenna 137*d* via antenna matching network 148*d*. Fourth single RF transceiver chain 304*d* is communicatively connected by second antenna switch 146*b* to either of fifth antenna 137*e* via antenna matching network 148*e* or sixth antenna 137*f* via antenna matching network 148*f*. In one or more embodiments, second antenna switch 146*b* is a two pole, single throw switch. In response to receiving an open position signal from housing position sensor 109, application processor 174 configures second antenna switch 146*b* to communicatively connect fourth single RF transceiver chain 304*d* to fifth antenna 137*e*.

Figure 3B:
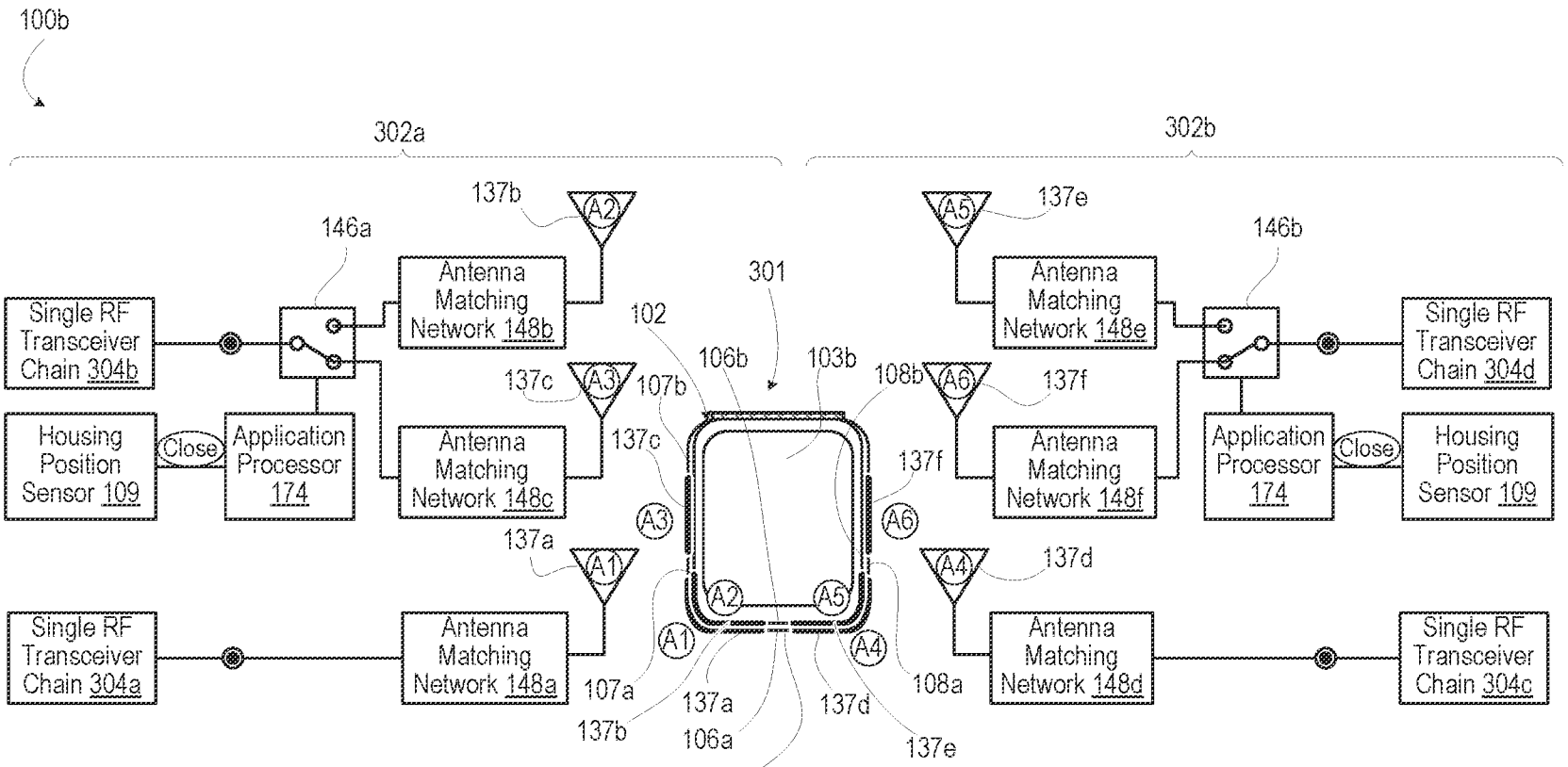
FIG. 3B depicts a functional block diagram of the example communication device of FIG. 3A having a configurable housing assembly in a closed position, according to one or more embodiments.

FIG. 3B depicts a functional block diagram of example communication device 100*b* as generally described for FIG. 3A but having housing assembly 102 in a closed position. In response to the closed position detected by housing position sensor 109, application processor 174 reconfigures first antenna switch 146*a* to communicatively connect second single RF transceiver chain 304*b* to third antenna 137*c* and reconfigures second antenna switch 146*b* to communicatively connect fourth single RF transceiver chain 304*d* to sixth antenna 137*f*. First and second antennas 137*a*-137*b* are aligned in parallel and too closely positioned to be used independently in low bands. Fourth and fifth antennas 137*d*-137*e* are also aligned in parallel and too closely positioned to be used independently in low bands. Separation for spatial diversity and other purposes are provided by using antenna switches 146*a*-146*b* to switch respectively to third and sixth antennas 137*c*, 137*f*. Communication device 100*b* is configured to continue using four single RF transceiver chains 304*a*-304*d* while housing assembly 102 is in the closed position communicating via first, third, fourth and sixth antennas 137*a*, 137*c*, 137*d* and 137*f*.

Figure 4A:
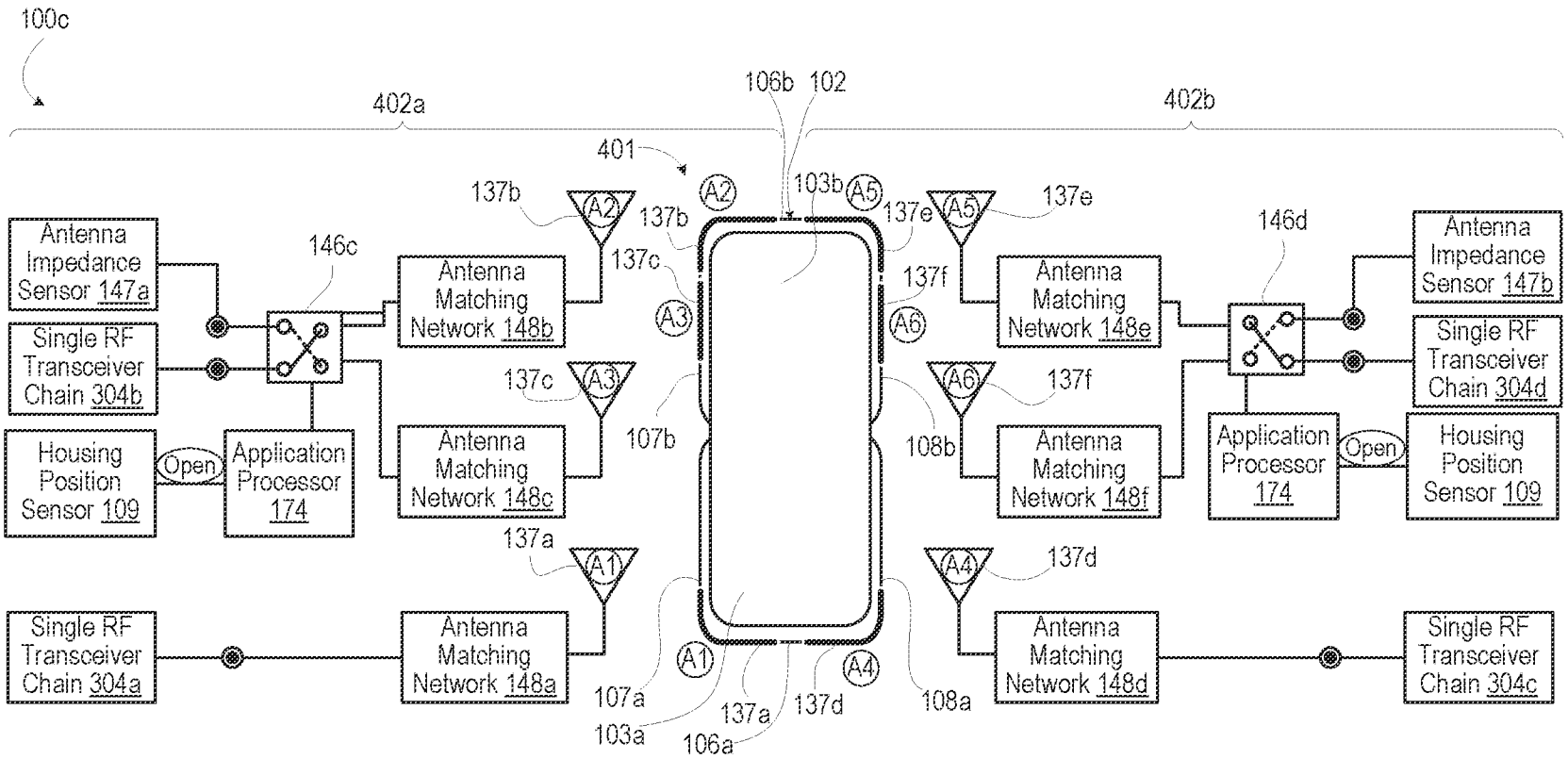
FIG. 4A depicts a functional block diagram of an example communication device having a configurable housing assembly supporting a second antenna arrangement in an open position, according to one or more embodiments.

FIG. 4A depicts a functional block diagram of example communication device 100*c* having second antenna arrangement 401 within housing assembly 102 that is in an open position. Communication device 100*c* can have identical or similar components and functionality as described for communication device 100 (FIG. 1). Communication device 100*c* is configured as communication device 100*b* but with changes in placement of third and sixth antennas 137*c*, 137*f*, configuration of first and second antenna switches 146*c*-146*d*, and addition of antenna impedance sensors 147*a*-147*b*. Third antenna 137*c* is positioned at first lateral side 107*b* of second housing portion 103*b*. Sixth antenna 137*f* is positioned at second lateral side 108*b* of second housing portion 103*b*. In one or more embodiments, first and second antenna switches 146*c*-146*d* are two pole, two throw switches. While housing assembly 102 is in the open position, first antenna switch 146*c* both communicatively connects the second RF transceiver chain 304*b* to second antenna 137*b* and first antenna impedance sensor 147*a* to third antenna 137*c*. While housing assembly 102 is in the open position, second antenna switch 146*d* both communicatively connects the second RF transceiver chain 304*d* to fifth antenna 137*e* and second antenna impedance sensor 147*b* to sixth antenna 137*f*.

Figure 4B:
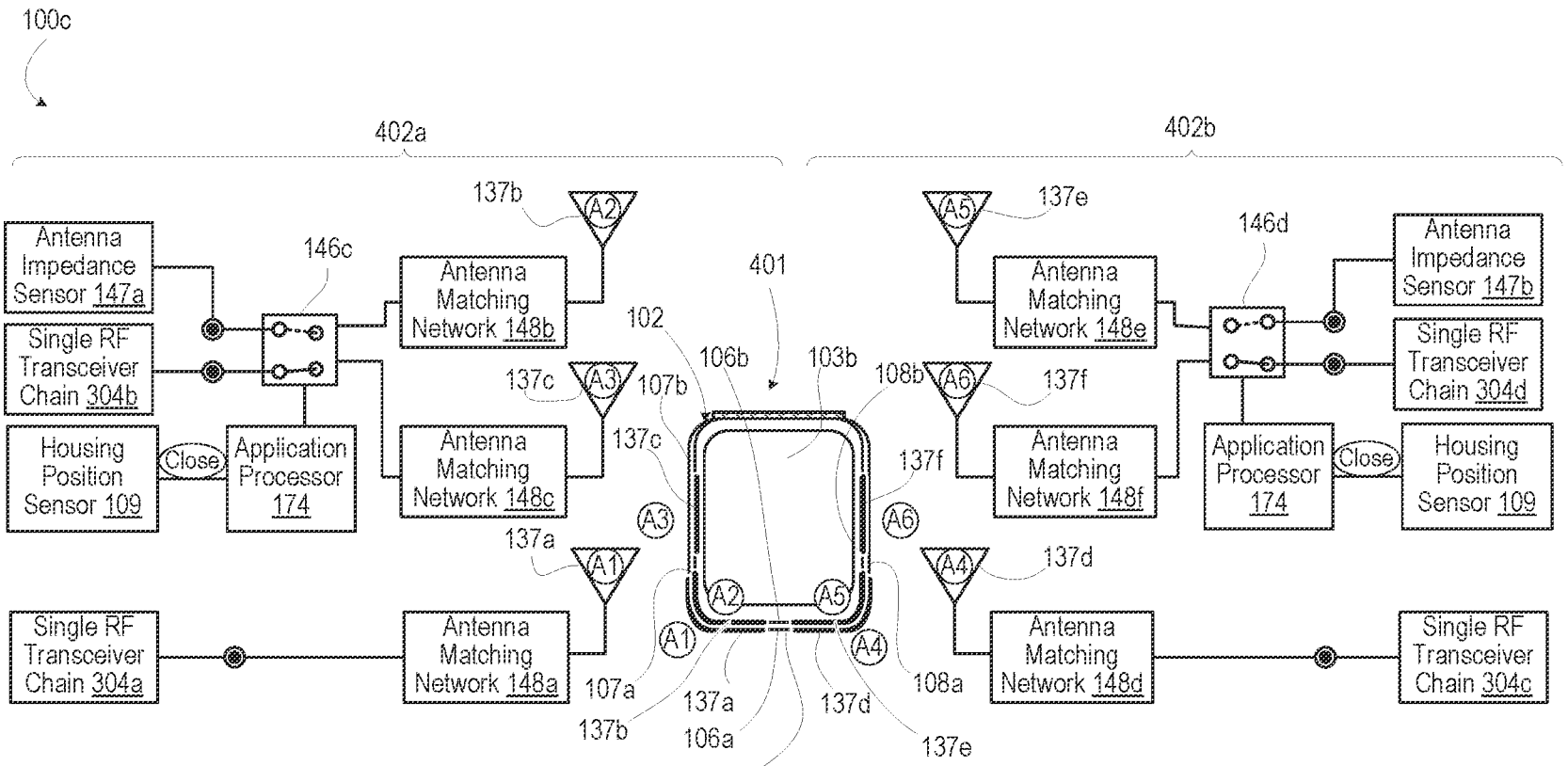
FIG. 4B depicts a functional block diagram of the example communication device of FIG. 4A having a configurable housing assembly in a closed position, according to one or more embodiments.

FIG. 4B depicts a functional block diagram of example communication device 100*c* as generally described for FIG. 4A but having housing assembly 102 in a closed position. In response to the closed position detected by housing position sensor 109, application processor 174 reconfigures first antenna switch 146*c* to communicatively connect second single RF transceiver chain 304*b* to third antenna 137*c* and first impedance sensor 147*a* to second antenna 137*b*. Application processor 174 reconfigures second antenna switch 146*d* to communicatively connect fourth single RF transceiver chain 304*d* to sixth antenna 137*f* and second antenna impedance sensor 147*b* to fifth antenna 137*e*. First and second antennas 137*a*-137*b* are aligned in parallel and too closely positioned to be used independently in low bands. Fourth and fifth antennas 137*d*-137*e* are also aligned in parallel and too closely positioned to be used independently in low bands. Separation for spatial diversity and other purposes are provided by using antenna switches 146*c*-146*d* to switch respectively to third and sixth antennas 137*c*, 137*f*. Communication device 100*c* is configured to continue using four RF transceiver chains 304*a*-304*d* while housing assembly 102 is in the closed position using first, third, fourth and sixth antennas 137*a*, 137*c*, 137*d* and 137*f*.

Figure 5A:
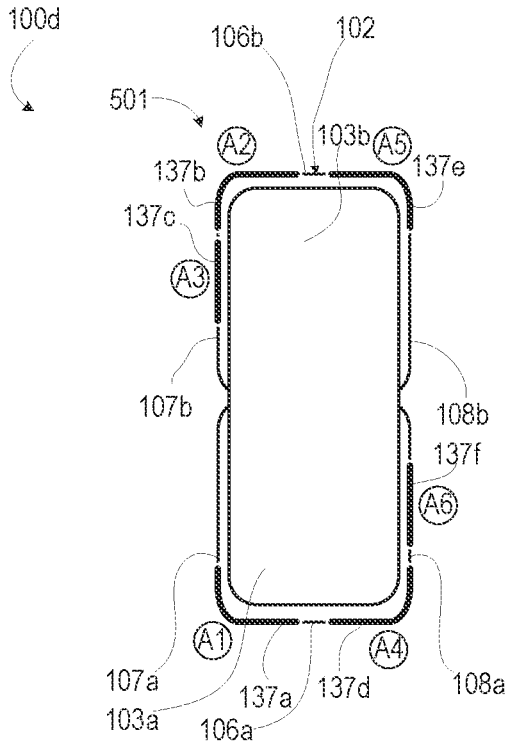
FIG. 5A depicts a functional block diagram of an example communication device having a configurable housing assembly supporting a third antenna arrangement in an open position, according to one or more embodiments.
Figure 5B:
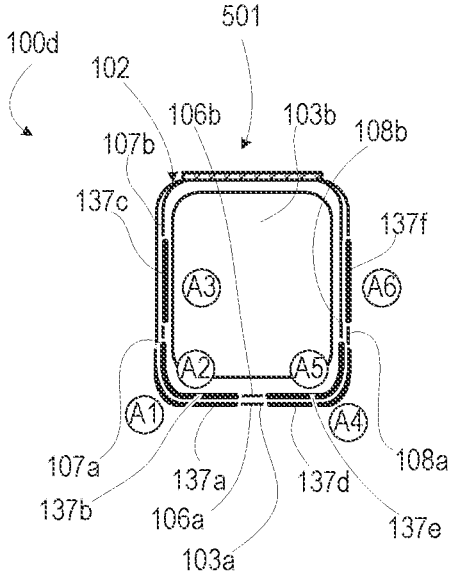
FIG. 5B depicts a functional block diagram of the example communication device of FIG. 5A having a configurable housing assembly in a closed position, according to one or more embodiments.

FIG. 5A depicts a functional block diagram of example communication device 100*d* having third antenna arrangement 501 within housing assembly 102 in an open position. FIG. 5B depicts a functional block diagram of example communication device 100*d* having housing assembly 102 in a closed position. In FIGS. 5A-5B, communication device 100*d* can have identical or similar components and functionality as described for communication device 100 (FIG. 1). Communication device 100*d* is configured as communication device 100*c* (FIGS. 4A-4B) but with changes in placement of third and sixth antennas 137*c*, 137*f* that are placed on different housing portions 103*a*-103*b*. As depicted, third antenna 137*c* is positioned at first lateral side 107*b* of second housing portion 103*b*. Sixth antenna 137*f* is positioned at second lateral side 108*a* of first housing portion 103*a*. In one embodiment that is not depicted, third antenna 137*c* is positioned at first lateral side 107*a* of first housing portion 103*a*, and sixth antenna 137*f* is positioned at second lateral side 108*b* of second housing portion 103*b*.

Figure 6A:
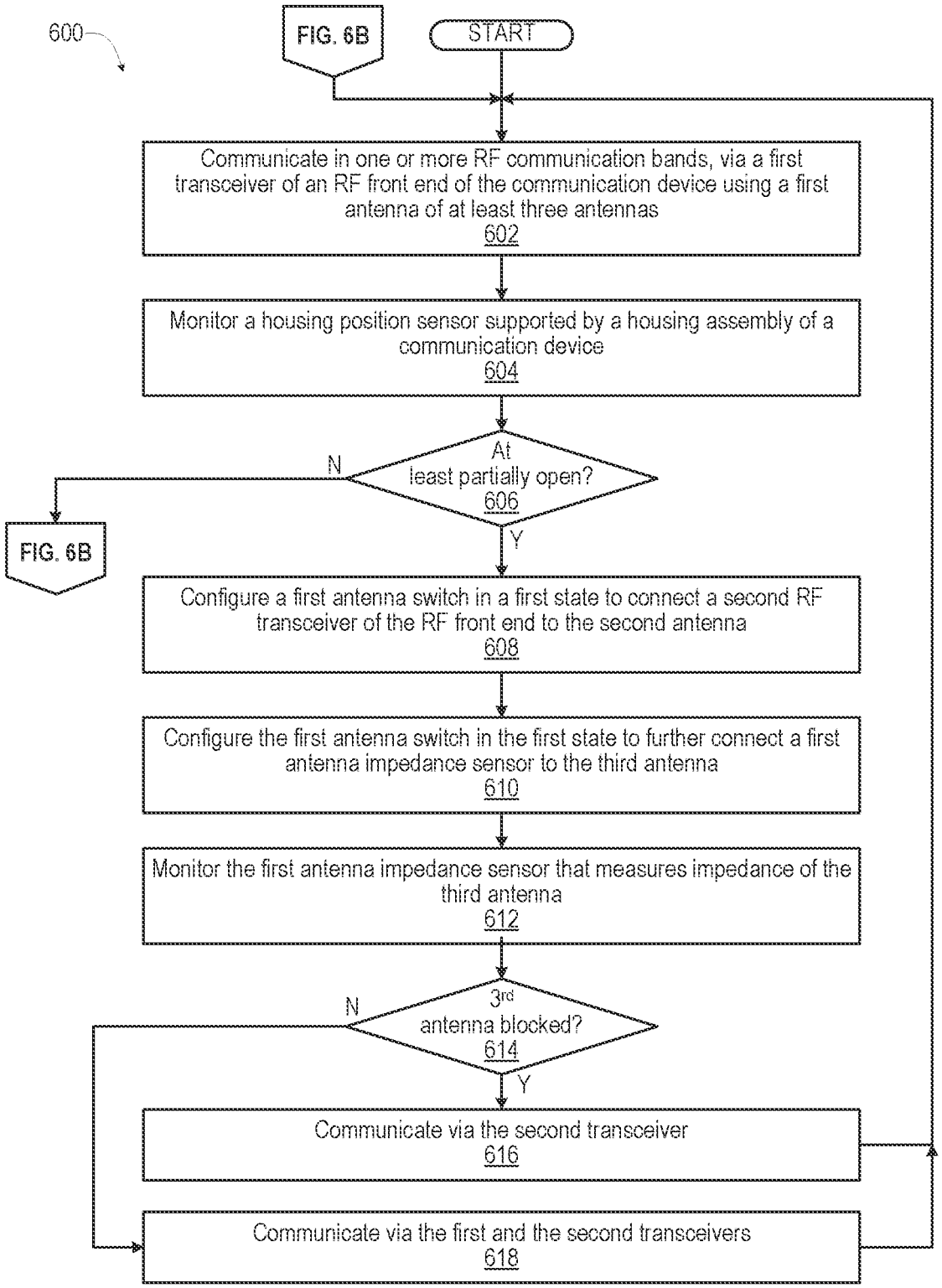
FIGS. 6A-6B (FIG. 6) present a flow diagram of a method for enabling multiple transceiver communication in a communication device having a configurable housing assembly, according to one or more embodiments.
Figure 6B:
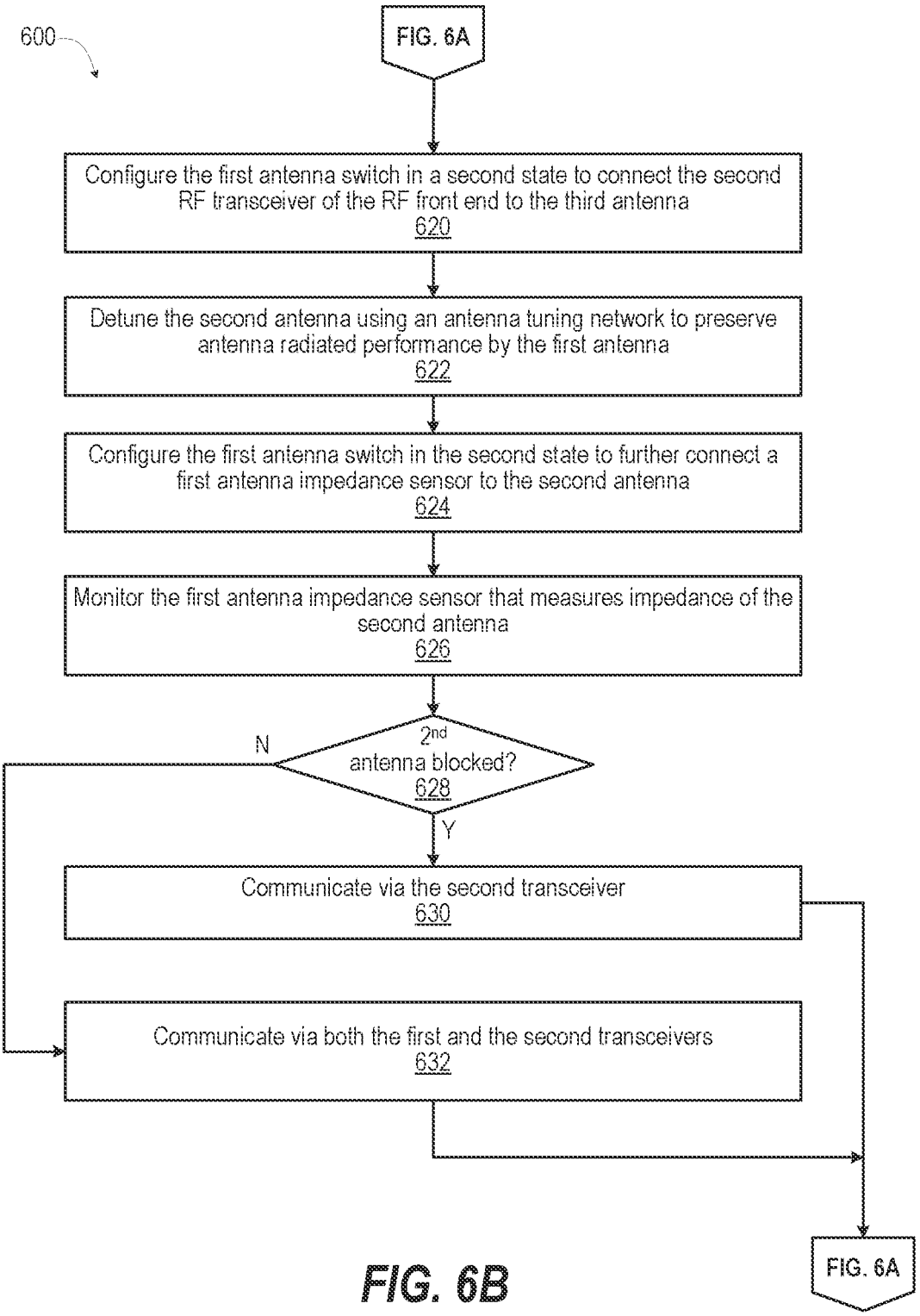

FIGS. 6A-6B (FIG. 6) present a flow diagram of a method for enabling multiple transceiver communication in a communication device having a configurable housing assembly. The description of method 600 is provided with general reference to the specific components illustrated within the preceding FIGS. 1, 2A-2C, 3A-3B, 4A-4B, and 5A-5B. In at least one embodiment, communication device 100, managed by controller 101, performs method 600 by dynamically configuring RF front end 139 using antenna feed/source networks in response to housing position sensor 109 (FIG. 1). Controller 101 executes antenna control application 115 (FIG. 1) to provide the multiple transceiver communication functionality of method 600. Specific components described in method 600 can be identical or similar to components of the same name used to describe preceding FIGS. 1, 2A-2C, 3A-3B, 4A-4B, and 5A-5B.

Method 600 includes communicating in one or more RF communication bands, via a first transceiver of an RF front end of the communication device using a first antenna of at least three antennas (block 602). Method 600 includes monitoring a housing position sensor within a housing assembly of a communication device (block 604). The housing position sensor detects: (i) when the housing assembly is in the closed position; and (ii) when the housing assembly is in an at least partially open position.

Method 600 includes determining whether the housing assembly is in the at least partially open position (decision block 606). In response to determining that the housing assembly is in the at least partially open position, method 600 includes configuring a first antenna switch in a first state to connect a second RF transceiver of the RF front end to the second antenna (block 608). In one or more embodiments, method 600 includes configuring the first antenna switch in the first state to further connect a first antenna impedance sensor to the third antenna (block 610). For example, the first antenna switch can be a two pole, two throw switch. Method 600 includes monitoring the first antenna impedance sensor that measures impedance of the third antenna (block 612). Method 600 includes determining whether the third antenna is blocked based on identifying a change greater than the threshold value in the impedance value measured by the second antenna impedance sensor (decision block 614). In response to determining that the third antenna is blocked, method 600 includes communicating via second transceiver (block 616). The controller can avoid using the third antenna that is closer to the first antenna than the second antenna. The controller can determine that blocking of the third antenna provides an indication to the controller that the first antenna could also be blocked. After block 616, method 600 returns to block 602. In response to determining that the third antenna is not blocked, method 600 includes communicating via both the first and the second transceivers (block 618). After block 618, method 600 returns to block 602.

Referring back to decision block 606, in response to determining that the housing assembly is not in the at least partially open position (i.e., the housing assembly is in the closed position), method 600 includes configuring the first antenna switch in a second state to connect the second RF transceiver of the RF front end to the third antenna (block 620). Method 600 includes detuning the second antenna using an antenna tuning network to preserve antenna radiated performance by the first antenna (block 622). In one or more embodiments, method 600 includes configuring the first antenna switch in the second state to further connect a first antenna impedance sensor to the second antenna (block 624). For example, the first antenna switch can be a two pole, two throw switch. Method 600 includes monitoring the first antenna impedance sensor that measures impedance of the second antenna (block 626). Method 600 includes determining whether the second antenna is blocked based on identifying a change greater than the threshold value in the impedance value measured by the second antenna impedance sensor (decision block 628). In response to determining that the second antenna is blocked, method 600 includes assigning communication workload to the second transceiver (block 630). For example, the second antenna is close to the first antenna in the closed position. Thus, communication workload can be shifted to the third antenna, presuming that the first antenna is also blocked. After block 630, method 600 returns to block 602 (FIG. 6A). In response to determining that the second antenna is not blocked, method 600 includes communicating in one or more RF communication bands including low band, via both the first and the second transceivers (block 632). In one or more embodiments, method 600 includes communicating in ultra-low band, low band, mid-band, high band, and ultra-high band communication by the RF front end in two or more simultaneous connections using the first and the second transceiver in support of one of carrier aggregation and dual connection of two RATs. After block 632, method 600 returns to block 602 (FIG. 6A).

In one or more embodiments, the communication device includes laterally symmetric portions of an antenna subsystem further including a fourth, a fifth, and a sixth antenna on an opposite lateral section to the first, second and third antennas. In one or more embodiments, the fourth, fifth and sixth antennas are configured in the same manner respectively as the first, the second, and the third antennas for use by a third and a fourth transceiver.

Aspects of the present innovation are described above with reference to flowchart illustrations and/or block diagrams of methods, apparatus (systems) and computer program products according to embodiments of the innovation. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

As will be appreciated by one skilled in the art, embodiments of the present innovation may be embodied as a system, device, and/or method. Accordingly, embodiments of the present innovation may take the form of an entirely hardware embodiment or an embodiment combining software and hardware embodiments that may all generally be referred to herein as a "circuit," "module" or "system."

While the innovation has been described with reference to exemplary embodiments, it will be understood by those skilled in the art that various changes may be made, and equivalents may be substituted for elements thereof without departing from the scope of the innovation. In addition, many modifications may be made to adapt a particular system, device, or component thereof to the teachings of the innovation without departing from the essential scope thereof. Therefore, it is intended that the innovation not be limited to the particular embodiments disclosed for carrying out this innovation, but that the innovation will include all embodiments falling within the scope of the appended claims. Moreover, the use of the terms first, second, etc. do not denote any order or importance, but rather the terms first, second, etc. are used to distinguish one element from another.

The terminology used herein is for the purpose of describing particular embodiments only and is not intended to be limiting of the innovation. As used herein, the singular forms "a", "an" and "the" are intended to include the plural forms as well, unless the context clearly indicates otherwise. It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present innovation has been presented for purposes of illustration and description but is not intended to be exhaustive or limited to the innovation in the form disclosed. Many modifications and variations will be apparent to those of ordinary skill in the art without departing from the scope and spirit of the innovation. The embodiments were chosen and described in order to best explain the principles of the innovation and the practical application, and to enable others of ordinary skill in the art to understand the innovation for various embodiments with various modifications as are suited to the particular use contemplated.

What is claimed is:

1. A communication device comprising:

a housing assembly having first and second housing portions connected at respective proximal sides for relative movement between an open position and a closed position about a lateral axis, each of the first and the second housing portions having a respective distal side opposite to the proximal side, and a first lateral side and a second lateral side extending between the respective proximal side and the distal side;

at least three antennas each having an elongated shape and configured to communicate in one or more radio frequency (RF) communication bands, the at least three antennas comprising a first, a second and a third antenna that are separated when the housing assembly is in the open position, the first antenna within the first housing portion, the second antenna is within the second housing portion, and the third antenna within one of the first and the second housing portions, the first antenna proximate to and substantially aligned in parallel with the second antenna and separated from the third antenna when the housing assembly is in the closed position;

a first antenna impedance sensor that measures an impedance value;

a first antenna switch;

an RF front end having a first RF transceiver that communicates via the first antenna and a second RF transceiver that communicates via a selected one of the second and the third antennas via the first antenna switch, the first antenna switch comprising a two pole, two throw switch, with the first pole communicatively coupled to the first RF transceiver, the second pole communicatively coupled to the first antenna impedance sensor, the first throw communicatively coupled to the second antenna, and the second throw communicatively coupled to the third antenna;

a housing position sensor within the housing assembly and that detects: (i) when the housing assembly is in the closed position; and (ii) when the housing assembly is in an at least partially open position; and a controller communicatively coupled to the first antenna switch and the housing position sensor, and which:

in response to determining that the housing assembly is in the at least partially open position, configures the first antenna switch in a first state to connect the second RF transceiver to the second antenna; and in response to determining that the housing assembly is in the closed position, configures the first antenna switch in a second state to connect the second RF transceiver to the third antenna.

2. The communication device of claim 1, further comprising a first antenna tuning network electrically connected to the second antenna and communicatively coupled to the controller, wherein the controller, in response to determining that the housing assembly is in the closed position, detunes the second antenna using the first antenna tuning network to preserve antenna radiated performance by the first antenna.

3. The communication device of claim 1, further comprising:

a second antenna switch communicatively coupled to the controller, wherein:

the at least three antennas comprise a fourth, a fifth, and a sixth antenna, and each of the first, the second, the third, the fourth, the fifth, and the sixth antenna are separated from each other when the housing assembly is in the at least partially open position, the fourth antenna within the first housing portion, the fifth antenna within the second housing portion, and the sixth antenna within one of the first and the second housing portions, the fourth antenna proximate and substantially aligned in parallel with the fifth antenna and separated from the sixth antenna when the housing assembly is in the closed position;

the RF front end comprises a third RF transceiver that communicates via the fourth antenna and a fourth RF transceiver that communicates selectively via one of the fifth and the sixth antennas via the second antenna switch; and the controller:

in response to determining that the housing assembly is in the at least partially open position, configures the second antenna switch to connect the fourth RF transceiver to the fifth antenna; and in response to determining that the housing assembly is in the closed position, configures the second antenna switch to connect the fourth RF transceiver to the sixth antenna; and a second antenna tuning network electrically connected to the fifth antenna and communicatively coupled to the controller, wherein the controller, in response to determining that the housing assembly is in the closed position, detunes the fifth antenna using the second antenna tuning network to preserve antenna radiated performance by the fourth antenna.

4. The communication device of claim 3, wherein the controller:

in response to determining that the housing assembly is in the closed position:

configures the first antenna switch in the second state to connect the first pole to the second throw and to connect the second pole to the first throw that communicatively couples the first antenna impedance sensor to the second antenna; and determines whether the second antenna is blocked based on identifying a change in the impedance value measured by the first antenna impedance sensor greater than the threshold value; and assigns communication workload to one or more of the first, the second, the third, and the fourth RF transceivers based at least in part on identifying whether the second or the third antenna is blocked.

5. The communication device of claim 3, wherein:

the first antenna is positioned at the distal side, proximate to the first lateral side of the first housing portion, and also positioned in a first lateral direction from a central longitudinal axis;

the second antenna is positioned at the distal side, proximate to the first lateral side of the second housing portion, and also positioned in the first lateral direction from the central longitudinal axis;

the third antenna is positioned at the first lateral side of one of the first and the second housing portions;

the fourth antenna is positioned at the distal side, proximate to the second lateral side of the first housing portion, and also positioned in a second lateral direction from a central longitudinal axis;

the fifth antenna is positioned at the distal side, proximate to the second lateral side of the second housing portion, and also positioned in the second lateral direction from the central longitudinal axis; and the sixth antenna is positioned at the second lateral side of one of the first and the second housing portions.

6. The communication device of claim 1, wherein the controller:

monitors the first antenna impedance sensor;

in response to determining that the housing assembly is in the at least partially open position:

configures the first antenna switch in a first state to connect the first pole to the first throw and to connect the second pole to the second throw that communicatively couples the first antenna impedance sensor to the third antenna; and determines whether the third antenna is blocked based on identifying a change in the impedance value measured by the first antenna impedance sensor being greater than a threshold value.

7. The communication device of claim 3, further comprising a second antenna impedance sensor that measures an impedance value, wherein:

the second antenna switch comprises a two pole, two throw switch with the first pole communicatively coupled to the third RF transceiver, the second pole communicatively coupled to the second antenna impedance sensor, the first throw communicatively coupled to the fifth antenna, and the second throw communicatively coupled to the sixth antenna; and the controller:

monitors the second antenna impedance sensor;

in response to determining that the housing assembly is in the at least partially open position:

configures the second antenna switch in a first state to connect the first pole to the first throw and to connect the second pole to the second throw that communicatively couples the second antenna impedance sensor to the sixth antenna; and determines whether the sixth antenna is blocked based on identifying a change in the impedance value measured by the second antenna impedance sensor being greater than the threshold value; and in response to determining that the housing assembly is in the closed position:

configures the second antenna switch in a second state to connect the first pole to the second throw and to connect the second pole to the first throw that communicatively couples the second antenna impedance sensor to the fifth antenna; and determines whether the fifth antenna is blocked based identifying a change in the impedance value measured by the second antenna impedance sensor greater than the threshold value; and assigns communication workload to one or more of the first, the second, the third, and the fourth RF transceivers based at least in part on identifying whether the fifth or the sixth antenna is blocked.

8. The communication device of claim 3, wherein:

the first, the second, the third, the fourth, the fifth, and the sixth antennas are configured for ultra-low band, low band, mid-band, high band, and ultra-high band communication; and the RF front end is configured for two or more simultaneous connections using the first, the second, the third, and the fourth RF transceiver in support of one of carrier aggregation and dual connection of two radio access technologies (RATs).

9. A method comprising:

monitoring a housing position sensor within a housing assembly of a communication device, the housing assembly having first and second housing portions at respective proximal sides connected for relative movement between an open position and a closed position about a lateral axis, each of the first and the second housing portions having a respective distal side opposite to the proximal side, and a first lateral side and a second lateral side extending between the respective proximal side and the distal side, the housing position sensor detects: (i) when the housing assembly is in the closed position; and (ii) when the housing assembly is in an at least partially open position;

wherein the communication device comprises: at least three antennas comprising a first, a second and a third antenna that are separated when the housing assembly is in the open position, the first antenna within the first housing portion, the second antenna is within the second housing portion, and the third antenna within one of the first and the second housing portions, the first antenna proximate to and substantially aligned in parallel with the second antenna and separated from the third antenna when the housing assembly is in the closed position; a first antenna impedance sensor that measures an impedance value; a first antenna switch; and an RF front end having a first RF transceiver that communicates via the first antenna and a second RF transceiver that communicates via a selected one of the second and the third antennas via the first antenna switch, the first antenna switch comprising a two pole, two throw switch, with the first pole communicatively coupled to the first RF transceiver, the second pole communicatively coupled to the first antenna impedance sensor, the first throw communicatively coupled to the second antenna, and the second throw communicatively coupled to the third antenna;

communicating in one or more radio frequency (RF) communication bands, via the first RF transceiver of the RF front end using the first antenna;

in response to determining that the housing assembly is in the at least partially open position:

configuring the first antenna switch in a first state to connect the second RF transceiver of the RF front end to the second antenna; and communicating in one or more RF communication bands, via the second RF transceiver using the second antenna; and in response to determining that the housing assembly is in the closed position:

configuring the first antenna switch in a second state to connect the second RF transceiver to the third antenna; and communicating in one or more RF communication bands, via by the second RF transceiver using the third antenna.

10. The method of claim 9, further comprising:

in response to determining that the housing assembly is in the closed position, detuning the second antenna using a first antenna tuning network to preserve antenna radiated performance by the first antenna.

11. The method of claim 9, wherein the at least three antennas comprise a fourth, a fifth, and a sixth antenna, and the method further comprises:

communicating in one or more RF communication bands, via a third transceiver of the RF front end using the fourth antenna, the fourth antenna within the first housing portion, the fifth antenna within the second housing portion, and the sixth antenna within one of the first and the second housing portions, the fourth antenna proximate to and substantially aligned in parallel with the fifth antenna and separated from the sixth antenna when the housing assembly is in the closed position;

in response to determining that the housing assembly is in the at least partially open position:

configuring a second antenna switch in a first state to connect a fourth RF transceiver of the RF front end to the fifth antenna; and communicating in one or more RF communication bands, via the fourth transceiver using the fifth antenna; and in response to determining that the housing assembly is in the closed position:

configuring the second antenna switch in a second state to connect the fourth RF transceiver to the sixth antenna; and communicating in one or more RF communication bands, via the fourth RF transceiver using the sixth antenna; and in response to determining that the housing assembly is in the closed position, detuning the fifth antenna using the second antenna tuning network to preserve antenna radiated performance by the fourth antenna.

12. The method of claim 11, further comprising:

in response to determining that the housing assembly is in the closed position:

communicatively coupling the first antenna impedance sensor to the second antenna by configuring the first antenna switch in a second state to connect the first pole to the second throw and to connect the second pole to the first throw to communicatively couple the first antenna impedance sensor to the second antenna; and determining whether the second antenna is blocked based on identifying a change in the impedance value measured by the first antenna impedance sensor greater than the threshold value; and assigning communication workload to one or more of the first, the second, the third, and the fourth RF transceivers based at least in part on identifying whether the second or the third antenna is blocked.

13. The method of claim 11, further comprising:

monitoring the first antenna impedance sensor; and in response to determining that the housing assembly is in the at least partially open position:

communicatively coupling the first antenna impedance sensor to the third antenna by configuring the first antenna switch in a first state to connect the first pole to the first throw and to connect the second pole to the second throw; and determining whether the third antenna is blocked based on identifying a change greater than the threshold value in the impedance value measured by the first antenna impedance sensor.

14. The method of claim 13, further comprising:

monitoring a second antenna impedance sensor that measures a second impedance value and that is communicatively coupled to a second pole of the second antenna switch, the second antenna switch being a two pole, two throw switch having a first pole communicatively coupled to the third transceiver, a first throw communicatively coupled to the fifth antenna, and a second throw communicatively coupled to the sixth antenna; and in response to determining that the housing assembly is in the at least partially open position:

communicatively coupling the second antenna impedance sensor to the sixth antenna by configuring the second antenna switch in a first state to connect the first pole to the first throw and to connect the second pole to the second throw to communicatively couple the second antenna impedance sensor to the sixth antenna; and determining whether the sixth antenna is blocked based on identifying a change in the impedance value measured by the second antenna impedance sensor greater than the threshold value; and in response to determining that the housing assembly is in the closed position:

communicatively coupling the second antenna impedance sensor to the fifth antenna by configuring the second antenna switch in a second state to connect the first pole to the second throw and to connect the second pole to the first throw to communicatively couple the second antenna impedance sensor to the fifth antenna; and determining whether the fifth antenna is blocked based on identifying a change in impedance value measured by the second antenna impedance sensor greater than the threshold value; and assigning communication workload to one or more of the first, the second, the third, and the fourth RF transceivers based at least in part on identifying whether the fifth or the sixth antenna is blocked.

15. The method of claim 11, further comprising:

communicating in ultra-low band, low band, mid-band, high band, and ultra-high band communication by the RF front end in two or more simultaneous connections using the first, the second, the third, and the fourth RF transceiver in support of one of carrier aggregation and dual connection of two radio access technologies (RATs).

16. A computer program product comprising:

a non-transitory computer readable storage device; and program code on the non-transitory computer readable storage device that when executed by a processor associated with a communication device, the program code enables the communication device to provide the functionality of:

monitoring a housing position sensor within a housing assembly of the communication device, the housing assembly having first and second housing portions at respective proximal sides connected for relative movement between an open position and a closed position about a lateral axis, each of the first and the second housing portions having a respective distal side opposite to the proximal side, and a first lateral side and a second lateral side extending between the respective proximal side and the respective distal side, the housing position sensor detects: (i) when the housing assembly is in the closed position; and (ii) when the housing assembly is in an at least partially open position;

wherein the communication device comprises: at least three antennas comprising a first, a second and a third antenna that are separated when the housing assembly is in the open position, the first antenna within the first housing portion, the second antenna is within the second housing portion, and the third antenna within one of the first and the second housing portions, the first antenna proximate to and substantially aligned in parallel with the second antenna and separated from the third antenna when the housing assembly is in the closed position; a first antenna impedance sensor that measures an impedance value; a first antenna switch; and an RF front end having a first RF transceiver that communicates via the first antenna and a second RF transceiver that communicates via a selected one of the second and the third antennas via the first antenna switch, the first antenna switch comprising a two pole, two throw switch, with the first pole communicatively coupled to the first RF transceiver, the second pole communicatively coupled to the first antenna impedance sensor, the first throw communicatively coupled to the second antenna, and the second throw communicatively coupled to the third antenna;

communicating in one or more radio frequency (RF) communication bands, via the first RF transceiver;

in response to determining that the housing assembly is in the at least partially open position:

configuring the first antenna switch in a first state to connect the second RF transceiver of the RF frontend to the second antenna; and communicating in one or more RF communication bands, via the second RF transceiver using the second antenna; and in response to determining that the housing assembly is in the closed position:

configuring the first antenna switch in a second state to connect the second RF transceiver to the third antenna; and communicating in one or more RF communication bands, via by the second RF transceiver using the third antenna.

17. The computer program product of claim 16, wherein the at least three antennas comprise a fourth, a fifth, and a sixth antenna, and wherein the program code enables the communication device to provide the functionality of:

communicating in one or more RF communication bands, via a third transceiver of the RF front end using the fourth antenna, the fourth antenna within the first housing portion, the fifth antenna within the second housing portion, and the sixth antenna within one of the first and the second housing portions, the fourth antenna proximate to and substantially aligned in parallel with the fifth antenna and separated from the sixth antenna when the housing assembly is in the closed position;

in response to determining that the housing assembly is in the at least partially open position:

configuring a second antenna switch in a first state to connect a fourth RF transceiver of the RF front end to the fifth antenna; and communicating in one or more RF communication bands, via the fourth transceiver using the fifth antenna; and in response to determining that the housing assembly is in the closed position:

configuring the second antenna switch in a second state to connect the fourth RF transceiver to the sixth antenna; and communicating in one or more RF communication bands, via the fourth transceiver using the sixth antenna.

18. The computer program product of claim 16, wherein the program code enables the communication device to provide the functionality of:

in response to determining that the housing assembly is in the at least partially open position:

communicatively coupling the first antenna impedance sensor to the third antenna by configuring the first antenna switch in a first state to connect the first pole to the first throw and to connect the second pole to the second throw; and determining whether the third antenna is blocked based on identifying a change greater than the threshold value in the impedance value measured by the first antenna impedance sensor.

19. The computer program product of claim 18, wherein the program code enables the communication device to provide the functionality of:

monitoring a second antenna impedance sensor that measures a second impedance value and that is communicatively coupled to a second pole of the second antenna switch, the second antenna switch being a two pole, two throw switch having a first pole communicatively coupled to the third transceiver, a first throw communicatively coupled to the fifth antenna, and a second throw communicatively coupled to the sixth antenna; and in response to determining that the housing assembly is in the at least partially open position:

communicatively coupling the second antenna impedance sensor to the sixth antenna by configuring the second antenna switch in a first state to connect the first pole to the first throw and to connect the second pole to the second throw to communicatively couple the second antenna impedance sensor to the sixth antenna; and determining whether the sixth antenna is blocked based on identifying a change in the impedance value measured by the second antenna impedance sensor greater than the threshold value; and in response to determining that the housing assembly is in the closed position:

communicatively coupling the second antenna impedance sensor to the fifth antenna by configuring the second antenna switch in a second state to connect the first pole to the second throw and to connect the second pole to the first throw to communicatively couple the second antenna impedance sensor to the fifth antenna; and determining whether the fifth antenna is blocked based on identifying a change in impedance value measured by the second antenna impedance sensor greater than the threshold value; and assigning communication workload to one or more of the first, the second, the third, and the fourth RF transceivers based at least in part on identifying whether the fifth or the sixth antenna is blocked.

20. The computer program product of claim 16, wherein the program code enables the communication device to provide the functionality of:

in response to determining that the housing assembly is in the closed position:

communicatively coupling the first antenna impedance sensor to the second antenna by configuring the first antenna switch in a second state to connect the first pole to the second throw and to connect the second pole to the first throw to communicatively couple the first antenna impedance sensor to the second antenna; and determining whether the second antenna is blocked based on identifying a change in the impedance value measured by the first antenna impedance sensor greater than the threshold value; and assigning communication workload to one or more of the first, the second, the third, and the fourth RF transceivers based at least in part on identifying whether the second or the third antenna is blocked; and communicating in ultra-low band, low band, mid-band, high band, and ultra-high band communication by the RF front end in two or more simultaneous connections using the first, the second, the third, and the fourth RF transceiver in support of one of carrier aggregation and dual connection of two radio access technologies (RATs).

* * * * *